US008626421B2

(12) United States Patent
Fink et al.

(10) Patent No.: US 8,626,421 B2
(45) Date of Patent: Jan. 7, 2014

(54) GLOWPLUG TEMPERATURE CONTROL METHOD AND DEVICE FOR THE REDUCTION OF EMISSIONS FROM A DIESEL ENGINE

(75) Inventors: Timo Fink, Darmstadt (DE); Andrei Kanev, Turin (IT); Stefano Cassani, Turin (IT); Simone Barbero, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 751 days.

(21) Appl. No.: 12/858,294

(22) Filed: Aug. 17, 2010

(65) Prior Publication Data

US 2011/0118952 A1 May 19, 2011

(30) Foreign Application Priority Data

Aug. 19, 2009 (GB) ..... 0914481.7

(51) Int. Cl.
*F02D 41/00* (2006.01)
*F01N 9/00* (2006.01)

(52) U.S. Cl.
USPC ..... 701/102

(58) Field of Classification Search
USPC ..... 701/102, 101, 114, 115; 60/273, 274, 60/285, 286
See application file for complete search history.

(56) References Cited

U.S. PATENT DOCUMENTS 5,094,198 A 3/1992 Trotta et al.
6,266,955 B1 * 7/2001 Liang et al. ..... 60/274

FOREIGN PATENT DOCUMENTS

EP 1780397 A1 5/2007
JP 5113167 A 5/1993
JP 9042137 A 2/1997

* cited by examiner

*Primary Examiner* — Hieu T Vo
(74) *Attorney, Agent, or Firm* — Ingrassia Fisher & Lorenz, P.C.

(57) ABSTRACT

A method is provided for reducing emissions behind a catalytic converter in an exhaust gas stream of the engine. The method includes, but is not limited to controlling a power supply to a glowplug of a compression-ignition engine. The glowplug is activated if a set of at least two input values remains in a first characteristic region of an input parameter space for at least a predetermined activation time. The first characteristic region consists of one ore more contiguous regions of the input parameter space.

20 Claims, 9 Drawing Sheets

GLOWPLUG TEMPERATURE CONTROL METHOD AND DEVICE FOR THE REDUCTION OF EMISSIONS FROM A DIESEL ENGINE

CROSS-REFERENCE TO RELATED APPLICATION

This application claims priority to British Patent Application No. 0914481.7, filed Aug. 19, 2009, which is incorporated herein by reference in its entirety.

TECHNICAL FIELD

The technical field is related to glowplugs, and more particularly to a glowplug temperature control method and device for the reduction of emissions from a diesel engine.

BACKGROUND

Diesel engines are typically equipped with a glowplug system. The glowplug system provides a general combustion aid during engine ignition and also during a warm-up phase of the running engine. A key component of this system is the glowplug whose tip can rise up to high temperatures of above 900° C. by means of an electrical to thermal power conversion.

Each cylinder is equipped with one glowplug which is turned on when needed on the base of engine and environmental conditions, typically in cold conditions. Glowplugs function as electrical resistors. Their resistance varies with temperature. As the temperature increases, the internal resistance increases, too.

Different technologies for glowplugs are in use. Glowplugs may be high or low voltage and they may be of different materials, such as metallic or ceramic glowplugs. High voltage glowplugs are typically supplied directly by a vehicle battery. Low voltage glowplugs in contrast, as they have a nominal voltage lower than the battery voltage, typically need a pulse width modulation (PWM) supply to get the correct voltage. Especially the low voltage glowplugs can be controlled easily by connecting the gates of MOSFETS of the PWM to an electronic control unit and controlling the duty cycle of the PWM.

For compression-ignition engines, the most commonly used catalytic converter is the diesel oxidation catalyst. This uses excess O2 (oxygen) in the exhaust gas stream to oxidize CO (carbon monoxide) to CO2 (carbon dioxide) and HC (hydrocarbons) to H2O (water) and CO2. These converters often reach 90% efficacy and help to reduce visible particulates (soot), however they are incapable of reducing NOx as chemical reactions always occur in the simplest possible way, and the existing O2 in the exhaust gas stream would react first. To reduce NOx on a compression ignition engine, the chemical composition of the exhaust must first be changed. Two main techniques are used: selective catalytic reduction (SCR) and NOx traps or NOx Absorbers.

An important development to increase the performance of a catalytic converter is to minimize emissions during the cold start by decreasing the catalyst light-off temperature.

During cold start, the temperature of the catalytic converter is low and the converter is not yet activated. Hence the catalyst light-off temperature at which the conversion of an exhaust gas component reaches 50% is not yet reached, hydrocarbons and CO are thus only not converted to a small extend which is why they contribute significantly to the total emissions in the legislated driving cycles during the first couple of minutes after the engine is started. Special techniques have been developed in order to minimize emissions during a cold start. These fast light-off techniques are either passive systems that employ changes in the exhaust system design, or they are active systems that rely on the controlled supply of additional energy to raise exhaust gas temperature during the cold start.

SUMMARY

According to the application, an improved glowplug control method for the reduction of exhaust gas emissions from a diesel engine is disclosed. Preferably, the emission reduction is achieved in conjunction with a catalytic converter for the diesel engine. According to the application, a method is disclosed for controlling a power supply to a glowplug in order to reduce emissions in an exhaust gas stream of the engine behind a catalytic converter. The glowplug is activated, or, in other words, supplied with power, if a set of at least two input values remains in a characteristic region of an input parameter space for at least a predetermined activation time.

The glowplug is deactivated again, or, in other words, the power supply to the glowplug is switched off, if the set of at least two input values remains outside a second characteristic region of the input parameter space for at least a predetermined deactivation time. The deactivation time may also be set to zero.

The first and second characteristic regions consist of one or more contiguous regions in the input parameter space. The input parameter space is defined by the input parameters and has as many dimensions as there are input parameters. The input values are the values that the input parameters take and are given by sensor output values or are derived from sensor output values by means of a computation. The first and second characteristic regions may be defined by specifying for each input value a range that is defined by a lower and an upper threshold. In this case, the characteristic region is given by a single contiguous region that takes the form of an n-dimensional cube.

Especially, the ranges for the input values may be defined for two input parameters. In this case, the characteristic region takes the form of a square. In a specific example, the input parameters are given by a crankshaft revolution speed and a combustion intake. The combustion intake may be derived, for example, from a fuel intake, an air intake or an intake of an air-fuel mixture.

In other embodiments, more than one range may be specified for an input parameter. Other shapes of contiguous regions, for example triangles, circles, spheres and ellipsoids, are possible and different shapes of contiguous regions may be combined to form a characteristic region in the input parameter space. There may be different characteristic regions for switching on and switching off of the glowplugs.

The activation and deactivation times and the characteristic regions are stored in a memory of a glowplug control device. They may also be computed by the glowplug control device, which activates and deactivates the glowplugs. A precise control of the glowplug activation and deactivation that makes use of the activation and deactivation times and the characteristic region according to the application allows reducing emissions effectively.

A control of the combustion conditions via activation and deactivation of a glowplug exhibits hysteresis effects in that an effect of a glowplug activation may occur after the glowplug activation and an effect may also persist after a glowplug deactivation. According to the application, the hysteresis is taken into account by suitably chosen time intervals and by providing different thresholds for the activation and the deactivation of a glowplug.

Apart from the crankshaft revolution speed and the fuel intake, further input values, such as intake air, intake air-fuel mixture, motor torque, vehicle speed, coolant temperature, ambient air temperature and engine intake air temperature may be used to define a characteristic region in the input parameter space. A glowplug is activated when the input values remain in the characteristic region for a predetermined activation time. The glowplug is switched off again when the input values remain outside the characteristic region for a predetermined deactivation time. The glowplugs may be switched on and off together or also sequentially.

A maximum activation period may be provided, after which the glowplug is deactivated again. The time intervals, such as the activation time, the activation period and the deactivation time may depend on a combustion chamber temperature or any value which is dependent on the combustion chamber temperature. The activation and the deactivation of the glowplugs may be based on time averaged input values, such as time averaged sensor signals, to further reduce unwanted oscillations in the on/off signal.

The application further discloses a method for controlling the power supply to at least one glowplug in which after activating the at least one glowplug the at least one glowplug remains activated for at least a hold time. The hold time may depend on a combustion chamber temperature.

The supplied mean voltage during the activation period of the glowplug may be determined individually for each glowplug. Also, the timing parameters like the activation period of the glow plug may be determined individually for each glowplug. The glowplugs may be activated and deactivated together or sequentially.

Although the control method will be explained with respect to a pulse width modulation control of glowplugs via MOSFETS, different technologies may also be used such as other types of transistors or a glowplug relays.

The method according to the application can be employed without the use of an integrated sensor in the glowplug or a sensor in the combustion chamber, although additional sensors may be used.

A glowplug control method according to the invention is able to identify an acceleration phase of the motor and to support the combustion during the acceleration phase when the combustion is not effective. The combustion efficiency is improved and in some cases even the overall efficiency of the engine. This leads to a reduction of emissions. Furthermore, the activation of the glowplug warms up the exhaust gases such that a catalyst light-off effect sets in earlier. Thus, the emissions can be reduced effectively.

The reduction of exhaust gas emissions is especially pronounced when the combustion is ineffective, for example during acceleration phases. According to the application, conditions which allow efficient emission reduction by glowplug activation can be identified by measuring a simple set of parameters. The parameters, such as crankshaft revolution speed and fuel intake are readily accessible.

As compared to a measurement of the exhaust gas temperature for triggering a glowplug activation, a measurement of engine parameters according to the application is able to detect changed conditions in the combustion chamber directly. It can therefore react faster and reduce the emissions more effectively. However, the exhaust gas temperature may be used as an additional input value.

The use of at least two input parameters according to the application, such as crankshaft revolution speed and fuel intake, allows it to differentiate efficiently between different conditions, such as acceleration under load and acceleration during gear shifting.

A method according to the invention may even be effective in reducing emissions when it is used in the 'warm condition' when a glowplug has already reached its steady state temperature.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
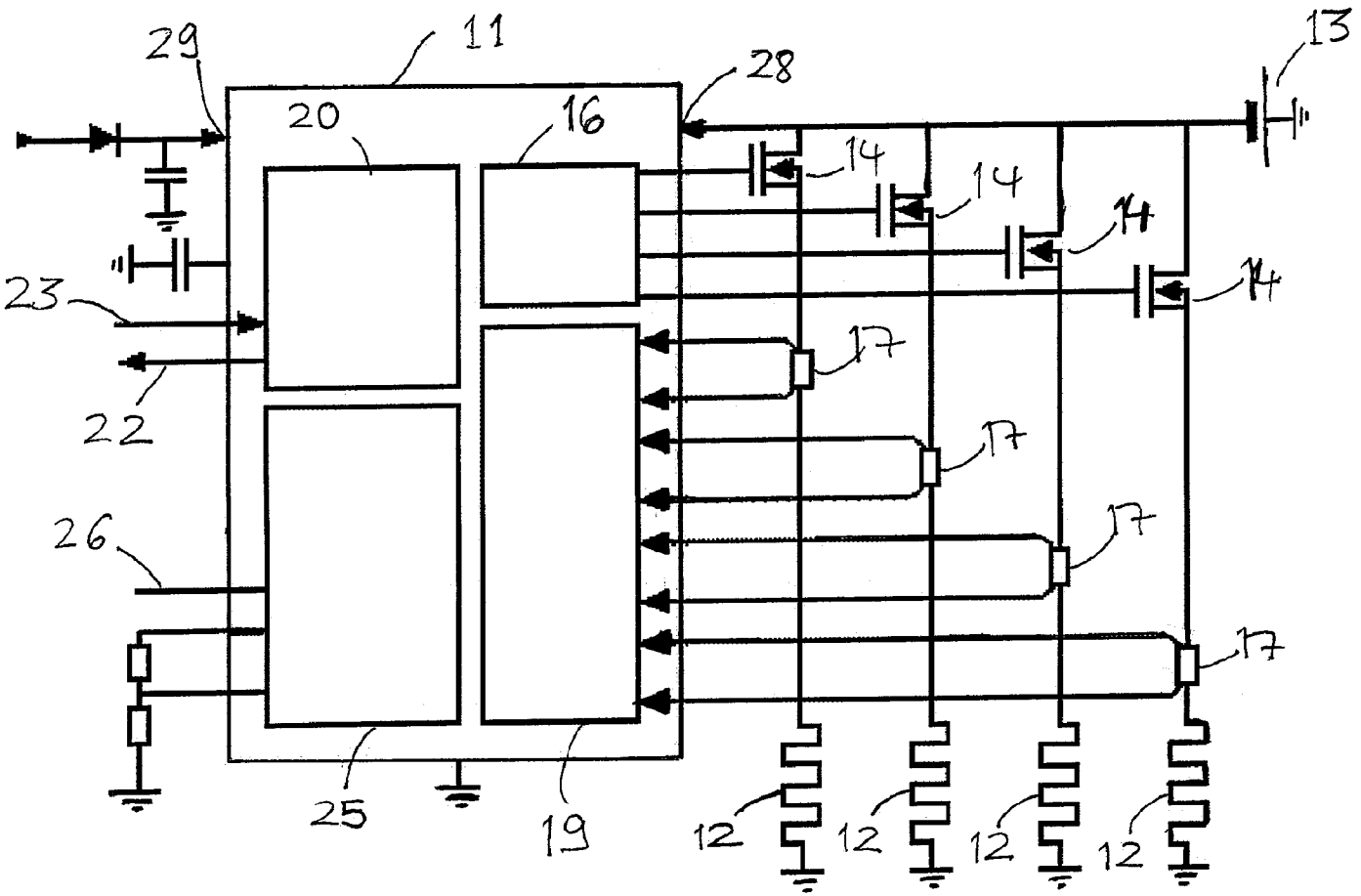
FIG. 1 illustrates a glowplug control device and controlled glowplugs.

FIG. 1 shows a glowplug control device 11 for electric glowplugs 12 which are symbolized by heating coils. The glowplugs 12 are connected to a power supply 13 via field effect transistors (MOSFETS) 14. A gate of each of the MOSFETS 14 is connected to a corresponding output of a gate drive unit 16 within the glowplug control device 11. Sense resistors 17 are provided between the drain of each MOSFET and the corresponding glowplug 12. An input and an output of each of the sense resistors 17 is connected to a corresponding output and a corresponding input of a diagnosis unit 19 within the glowplug control device 11.

The glowplug control device 11 further comprises a logic unit 20 which in turn comprises a diagnostic logic and control logic. A diagnosis output 12 of the logic unit 20 is connected to an engine control unit (ECU) which is not shown. A control input 23 of the logic unit 20 is connected to the ECU. Furthermore, the glowplug control device 11 comprises a mode programming unit 15. The mode programming unit 15 is connected to sensor outputs via an input 26. A voltage sensing input 28 of the glowplug control device 11 is connected to the power supply 13 and a power input 29 of the glowplug control device 11 is connected to a supply voltage.

During operation, the logic unit 20 receives control input from the ECU and the mode programming unit 15 receives sensor values via the input 26. Based on the sensor values the mode programming unit 15 determines an operation mode and sends corresponding output values to the logic unit 20. The sensor values may include, among others, the temperature of an engine coolant, for example of the cooling water, the engine speed, the injected fuel and the output torque of the engine. The ECU makes use of a suitable model to derive a combustion chamber temperature from sensor values and provides the derived combustion chamber temperature at the input 26. The ECU may also provide further information to the glowplug control device 11, for example the length of a previous idle phase of the engine motor.

The control logic of the logic unit 20 computes a desired effective voltage for each of the glowplugs 12 which is based on the input values to the glowplug control device 11. The gate drive unit 6 uses the desired effective voltages to compute a length of a duty cycle of a pulse width modulation for each of the glowplugs 12 and controls the gates of the MOSFETS 14 according to the duty cycle.

Via the inputs and outputs to the sense resistors 17, the diagnosis unit 19 derives a voltage drop for each of the sense resistors 17. From the voltage drops, the diagnostic unit derives supply currents for each of the glowplugs 2. The diagnostic unit 19 provides the values of the derived supply currents to the mode programming unit 25. Furthermore, the diagnostic unit 19 generates an error condition if the derived supply current is higher or lower than specified boundary values.

Figure 2:
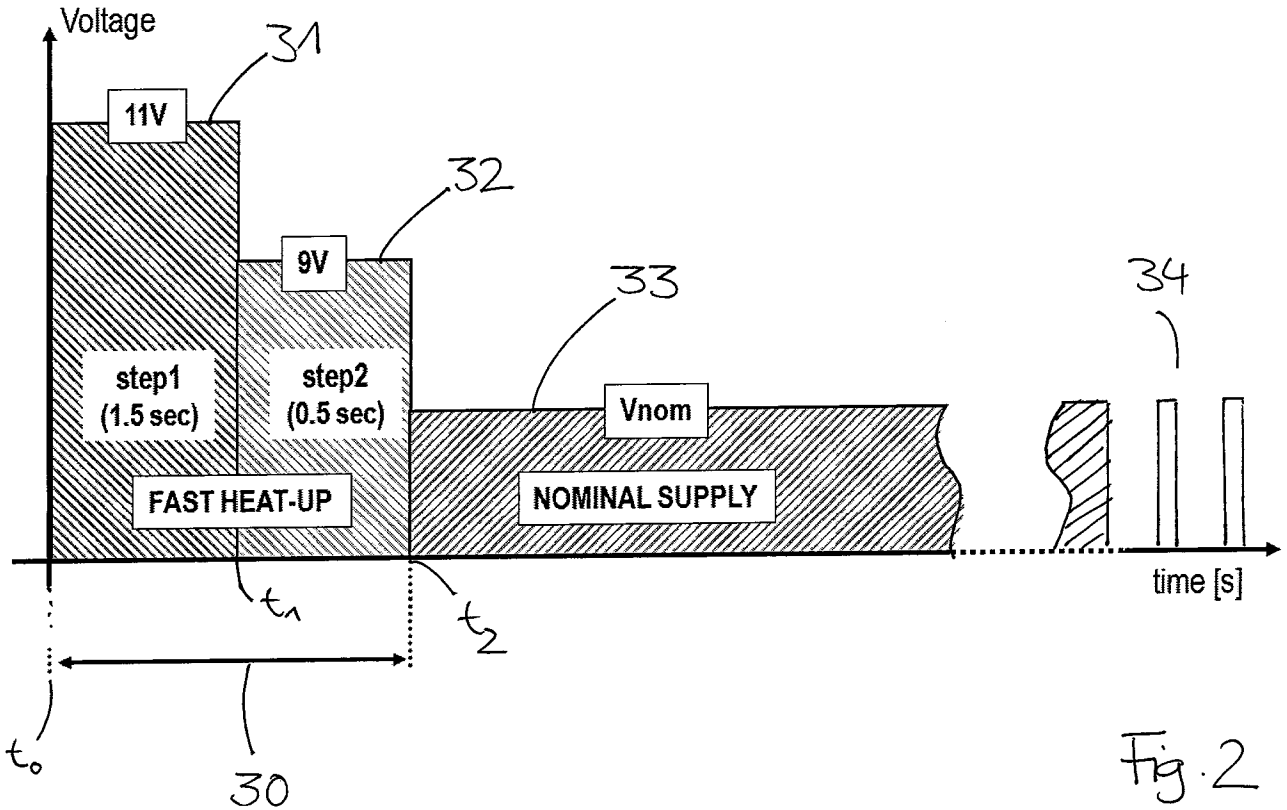
FIG. 2 illustrates an applied voltage to a glowplug during an engine warm up phase.

FIG. 2 shows the average supply voltages of a glowplug current supply during a preglow phase of a glowplug. During a fast heat up phase 30 from time t0 to time t2, the glowplug is heated at an elevated voltage. The fast heat up phase is subdivided into a first fast heat up phase 31 from time t0 to time t1 in which an average voltage of 11 V is supplied and a second fast heat up phase during which an average voltage of 9 V is supplied. During a heating phase 33, the glowplug is supplied with its nominal voltage. The length of the heating phase is not drawn to scale, which is symbolized by a gap. After the heating phase, an after-glow phase 34 starts in which the glowplug is only activated from time to time.

Figure 3:
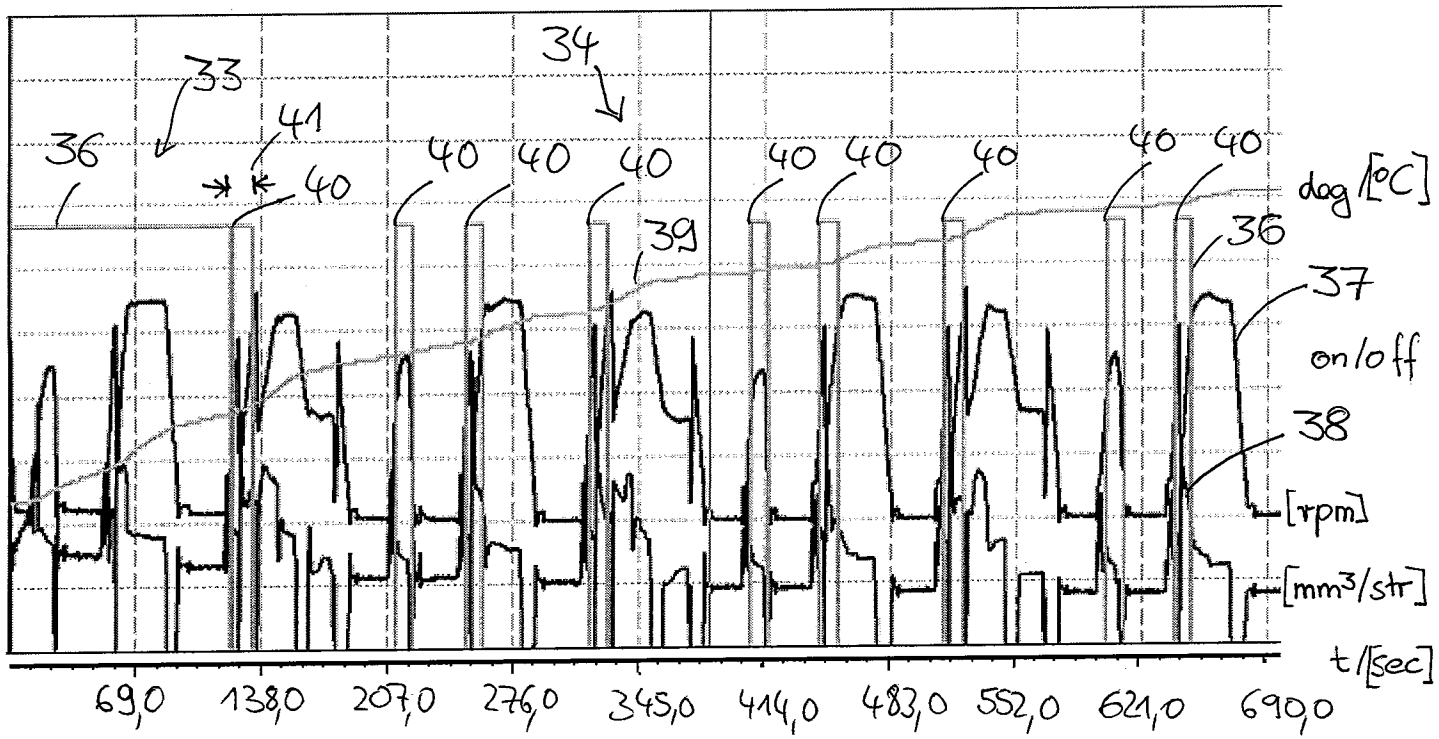
FIG. 3 illustrates measurement data and a first glowplug activation pattern.

The diagram of FIG. 3 illustrates a glowplug activation pattern which arises when a glowplug 12 is activated according to a control algorithm according to the application and the motor is driven according to Urban Drive Cycles (UDC) of the New European Drive Cycle (NEDC). The control algorithm is explained below with respect to FIGS. 7 and 8.

The diagram of FIG. 3 shows a square wave on/off signal 36 of a glowplug 12, a crankshaft revolution speed signal 37, a fuel intake signal 38 and a cooling water temperature signal 39. The signals are measured in volt, revolutions per minute, cubic millimeter per stroke degrees Celsius, respectively. A time scale is given in seconds. The diagram shows a time window from about 69 seconds after a cold start of the diesel engine to 690 seconds after the cold start of the diesel engine.

According to the temperature signal 39, the cooling water temperature rises continually in a logarithm like pattern until a final temperature of about 60° C. is almost reached. The continuous activation of the glowplug 12 ends at about 120 seconds. After the continuous activation, the glowplug 12 is controlled by a control algorithm according to the application and remains switched on for an activation period 41 only. In the case of the UDC an activation pattern of activation periods 40 results that has the periodicity of the UDC phases. This can be seen particularly well in comparison with the crankshaft revolution signal 37. In the example of FIG. 3, a total activation duration of 90 seconds of the glowplug results.

The maxima of the crankshaft revolution signal 39 reflect the three velocity phases of an UDC. In the diagram, the pattern of the three maxima repeats itself almost four times, which means that the diagram covers almost four UD cycles. The glowplug activation starts approximately with the UDC phase. Furthermore, the idling speed of the motor between the phases decreases slightly.

The periodicity of the crankshaft revolution signal 37 is also reflected in the pattern of the fuel intake signal 38. However, the fuel intake signal 38 is modified by the changing conditions in the combustion chambers. The fuel consumption decreases and the spikes before the first and the third UDC phase almost disappear. The spike before the second UDC phase decreases. Furthermore, several negative spikes of the fuel intake signal mark times when the fuel consumption goes down to very low values due to reduced load during gear switching.

Figure 4:
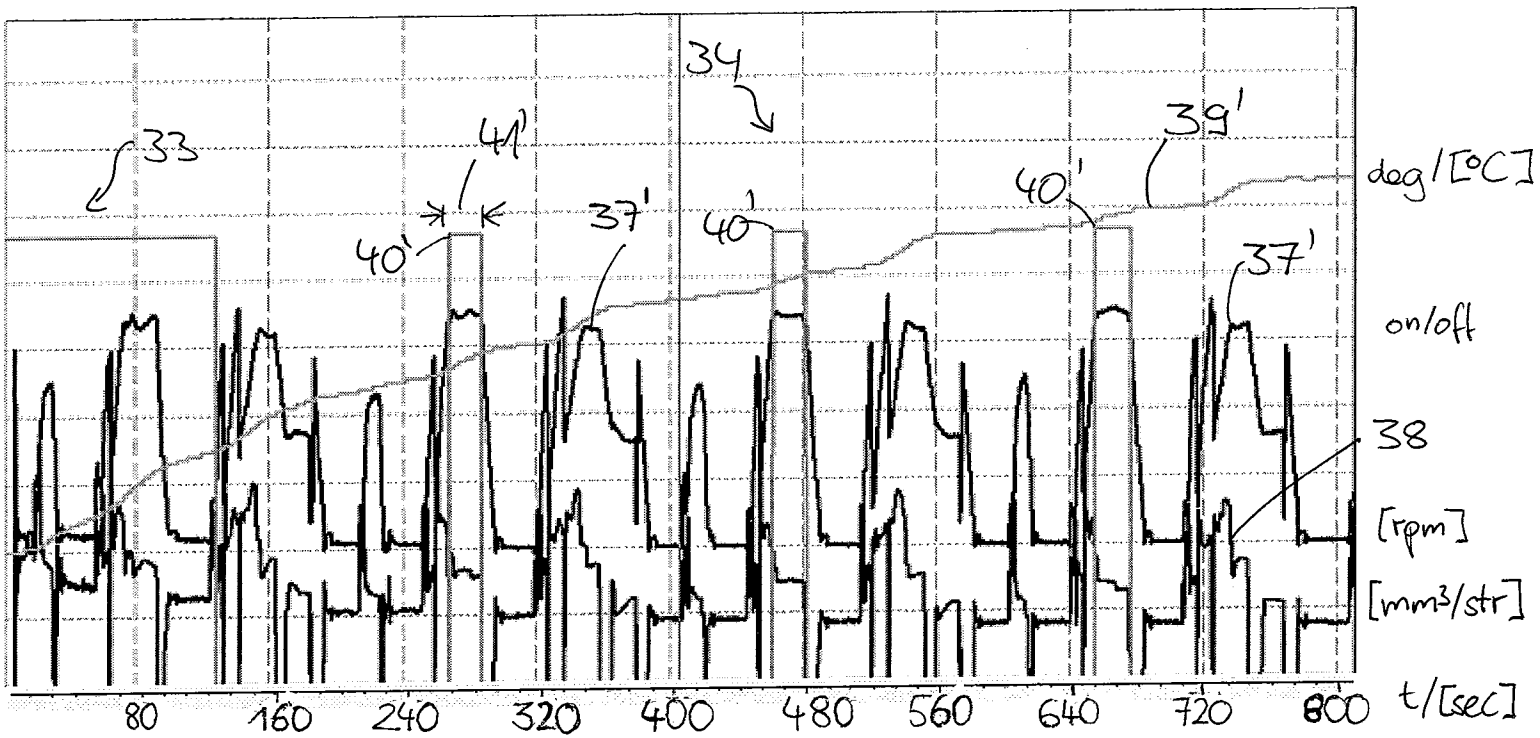
FIG. 4 illustrates measurement data and a second glowplug activation pattern.

FIG. 4 shows a diagram with a second glowplug activation pattern which is due to a simplified algorithm. According to the simplified method, the glowplug is activated when the crankshaft revolution speed is above a threshold value for a certain minimum time. The glowplug is deactivated if the crankshaft revolution speed falls below the threshold value. According to the diagram, the glowplug is only activated during the second phase of the UDC. In the first UDC phase the glowplug is not activated due to low velocity and in the third UDC phase it is not activated due to gear shifting. As a result, the glowplug is activated for 3×20=60 seconds.

Figure 5:
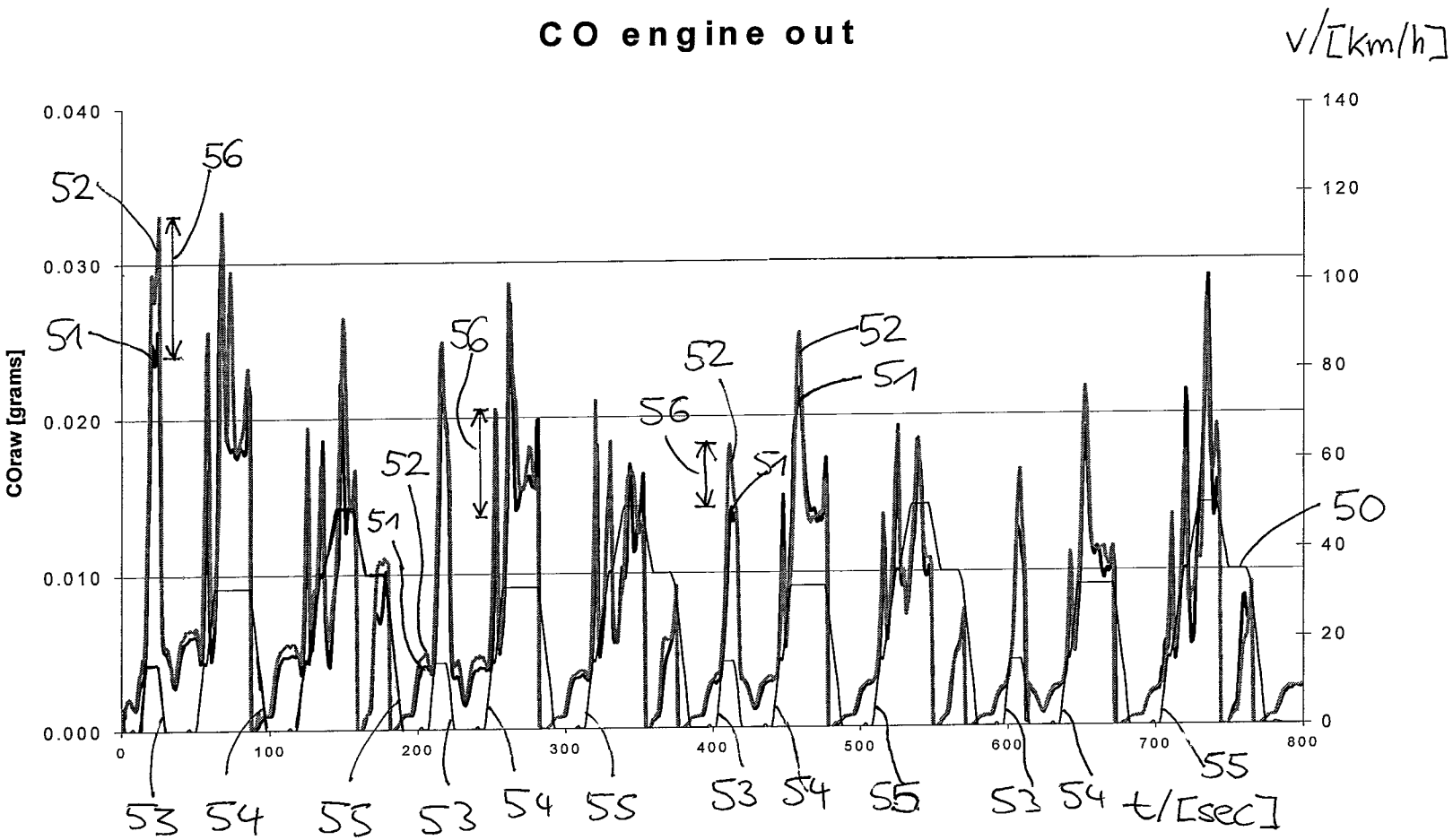
FIG. 5 illustrates a comparison of engine CO emissions for the glowplug activation patterns of FIG. 3 and FIG. 4.
Figure 6:
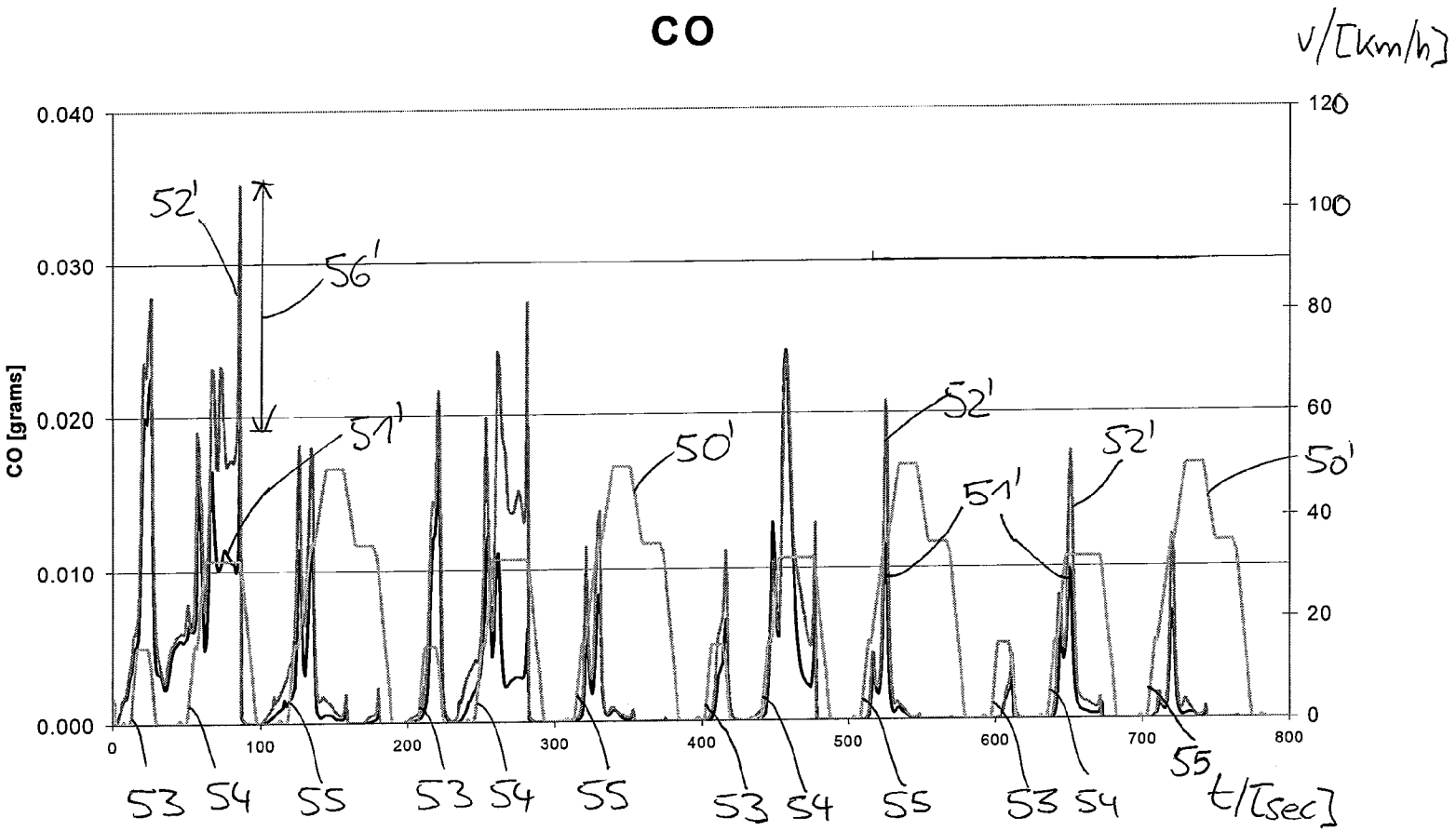
FIG. 6 illustrates a comparison of exhaust CO emissions for the glowplug activation patterns of FIG. 3 and FIG. 4.

FIG. 5 and FIG. 6 show a comparison of CO emissions for a glowplug control method according to the application and for the second control method. In FIG. 5, the raw emission of CO from the engine is shown while in FIG. 6 the cleansed emission of CO behind a catalytic converter is shown.

In the diagram of FIG. 5, a velocity curve 50, a first raw emission curve 51 and a second raw emission curve 52 is shown. Scales are in km/h and grams CO/second. The velocity curve comprises four UD cycles which have a first phase 53, a second phase 54 and a third phase 55 respectively. The first raw emission 51 curve differs from the second raw emission curve 52 mainly in the emission peaks where emissions from the first raw emission curve are lower. The differences are indicated by distances 56.

In the diagram of FIG. 6, a velocity curve 50', a first emission curve 51' and a second emission curve 52' are shown. Scales are indicated in km/h and grams CO/second. As in FIG. 5, the first raw emission curve 51' differs from the second raw emission curve 52' in the emission peaks where emissions from the first raw emission curve are lower. In addition, emissions of the first raw emission curve 51' during the second UD cycle are also significantly lower. All in all, this results in a significant reduction of CO emission when the glowplugs are heated by a method according to the application as compared to the second control method. This result holds despite the fact that also according to the second control method the glowplug is activated during the second phase of the UD cycle.

FIG. 5 and FIG. 6 show that generally the raw emissions decrease as the cooling water and hence the combustion chambers reach its final temperature. FIG. 6 shows in addition that the efficiency of the catalytic converter improves significantly as the combustion chambers heat up. A similar result as for FIG. 5 and FIG. 6 is also valid for the NOx emissions.

Figure 7:
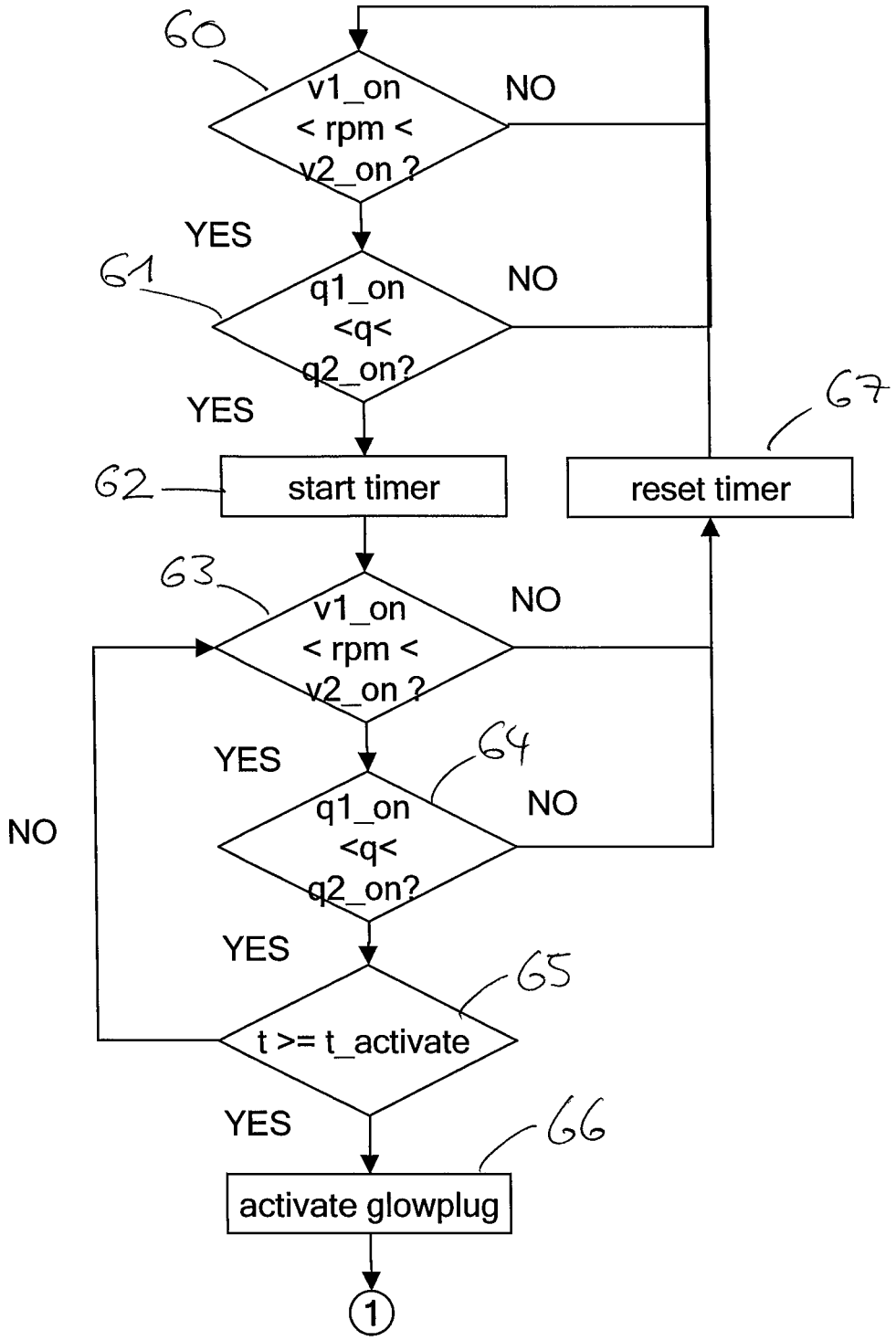
FIG. 7 illustrates a method for glowplug activation.
Figure 8:
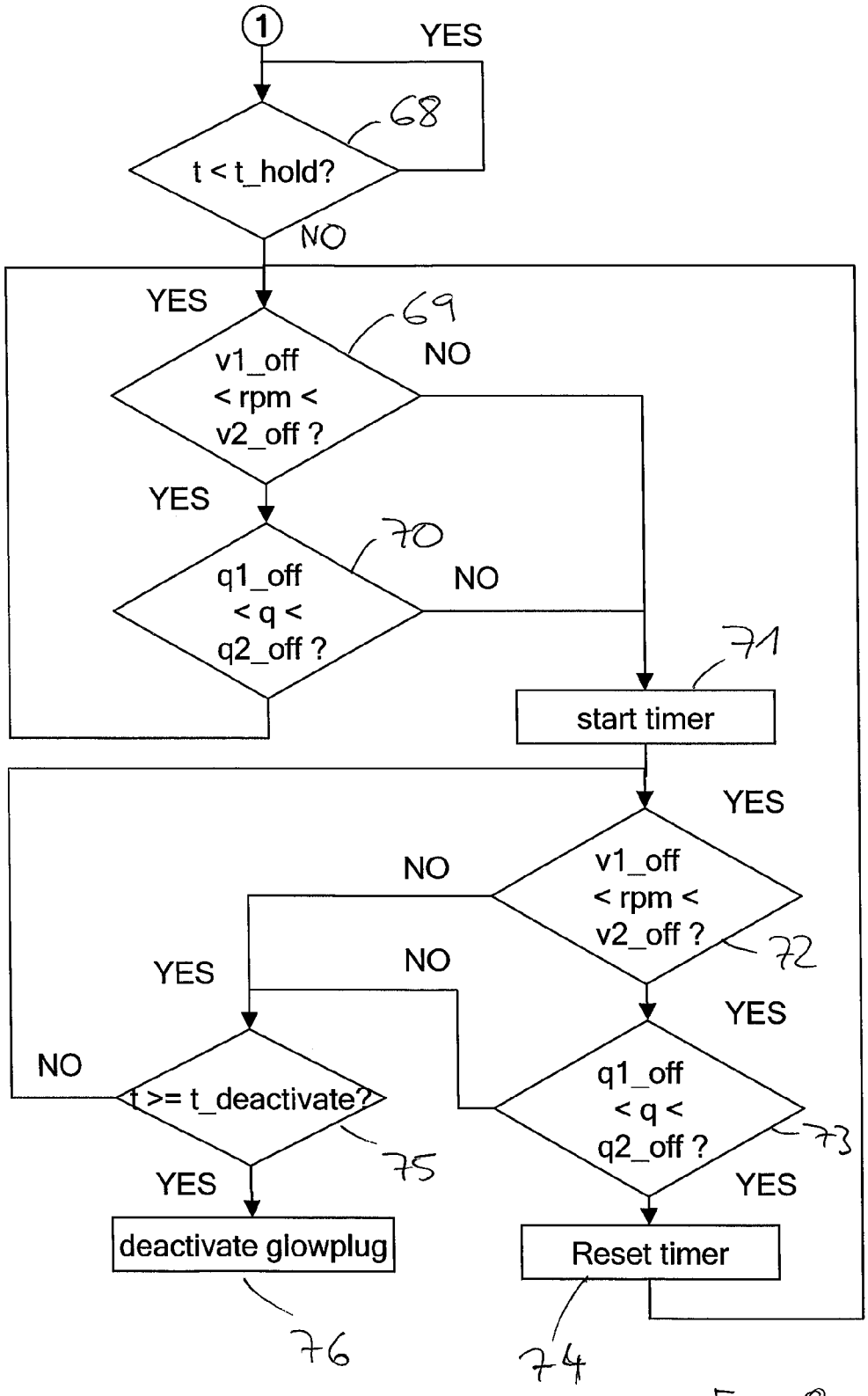
FIG. 8 illustrates a method for glowplug deactivation.

FIG. 7 and FIG. 8 show a glowplug control algorithm according to the application. FIG. 7 illustrates an activation of a glowplug. It also refers to the activation of several glowplugs which may be activated simultaneously or sequentially. In decision steps 60 it is tested whether the crankshaft revolution speed is between a lower threshold v1_on and an upper threshold v2_on. If this is the case, it is tested in a further decision step 61, if the fuel intake is between a lower threshold q1_on and an upper threshold q2_on. If the crankshaft revolution speed and the fuel intake lie in the respective ranges, a timer is started in step 62, otherwise decision steps 60, 61 are repeated.

After start of the timer, it is again tested in decision steps 63 and 64 if the crankshaft revolution speed and the fuel intake lie in their respective ranges. If this is the case, it is tested in decision step 65 whether an activation time t_activate has been reached. Otherwise, the timer is reset in step 67 and the algorithm loops back to decision step 60. If, in decision step 65, it is determined that the activation time has been reached, the glowplug is activated in step 65. Otherwise, the algorithm loops back to decision step 63.

FIG. 8 illustrates a deactivation of a glowplug. It also refers to the deactivation of several glowplugs which may be deactivated simultaneously or sequentially. In a decision step 68 it is tested whether hold time t_hold has already been reached. If this is the case, it is tested in decision step 69 whether the crankshaft revolution speed lies between a lower threshold v1_off and an upper threshold v2_off. In a decision step 70 it is tested whether the fuel intake lies between a lower threshold q1_off and an upper threshold q2_off. If the crankshaft revolution speed and the fuel intake lie in their respective ranges, the algorithm loops back to decision step 69. Otherwise a timer is started in step 71.

In a decision step 72 it is again tested whether the crankshaft revolution speed lies between the lower threshold v1_off and the upper threshold v2_off. In a decision step 73 it is again tested whether the fuel intake lies between the lower threshold q1_off and the upper threshold q2_off. If the crankshaft revolution speed and the fuel intake lie within their respective ranges, the timer is reset in step 74 and the algorithm loops back to decision step 69. Otherwise, it is tested in decision step 75 whether a deactivation time t_deactivate has been reached. If this is the case, the glowplug is deactivated in step 76. Otherwise, the algorithm loops back to decision step 72.

The engine control unit may—on the basis of data such as cooling water temperature—decide to suspend the glowplug activation. Otherwise, the decision step 60 of FIG. 8 is executed after deactivation of the glowplug 12.

According to the application, ranges for fuel intake and crankshaft speed are defined by calibratable upper and lower thresholds which may be calibrated at the production facility or at a workshop. After the deactivation step 76, the glowplug or the glowplugs may remain deactivated for a predetermined deactivation period until step 60 is repeated again.

Figure 9:
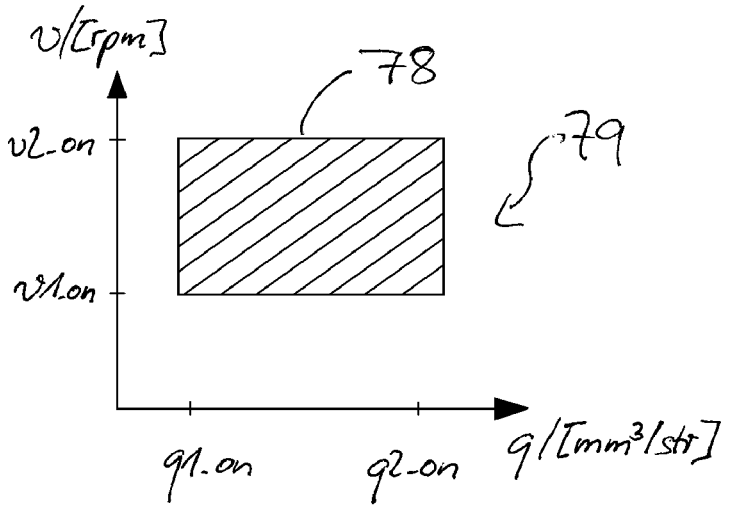
FIG. 9 illustrates a first characteristic region.

FIG. 9 illustrates the definition of a characteristic region 78 in an input parameter space 79. The characteristic region 78 is defined by the ranges [q1_on, q2_on] and [v1_on, v2_on]. The definition of ranges leads to a box shape of the characteristic region or, in the case of more then three input parameters, to a multidimensional cube.

Figure 10:
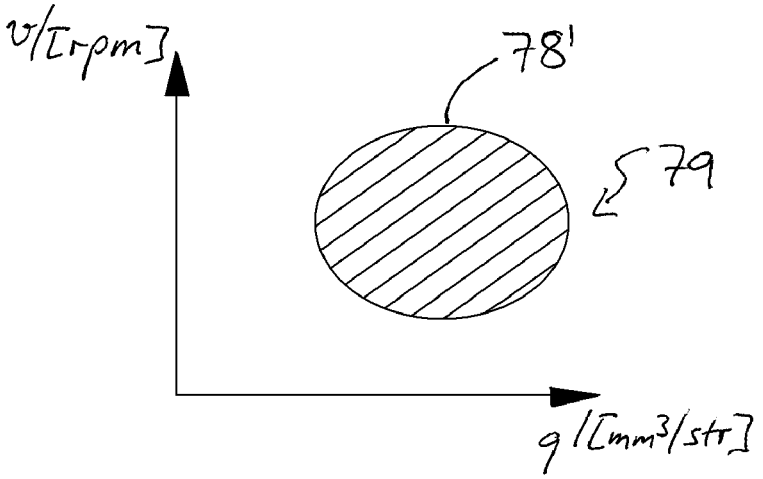
FIG. 10 illustrates a second characteristic region.

FIG. 10 illustrates the definition of another characteristic region 78' in an input parameter spaces which is oval shaped. In the case the more general shape of FIG. 10, the test for ranges [q1_on, q2_on] and [v1_on, v2_on] of the input parameters q and v must be replaced by a test whether the value (q,v) lies within the characteristic region 78'. Therefore, for a general shape of the characteristic region 78', previously explained decision steps like for example the steps 60, 61 must be modified accordingly. Like characteristic region 78, the characteristic region 78' forms a contiguous region as opposed to several disconnected regions.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method for controlling a power supply to at least one glowplug of a compression-ignition engine for reducing emissions behind a catalytic converter in an exhaust gas stream of the compression-ignition engine, comprising:

activating the at least one glowplug if a set of at least two input values remains in a first characteristic region of an input parameter space for at least a predetermined activation time and wherein the first characteristic region consists of one or more contiguous regions of the input parameter space.

2. The method according to claim 1, further comprising deactivating the at least one glowplug if the set of at least two input values remains outside a second characteristic region of the input parameter space for at least a predetermined deactivation time and wherein the second characteristic region consists of one ore more contiguous regions of the input parameter space.

3. The method according to claim 2, wherein the first characteristic region coincides with the second characteristic region.

4. The method according to claim 2, wherein the first characteristic region and the second characteristic region are multidimensional cubes in the input parameter space.

5. The method according to claim 2, wherein the at least one glowplug is deactivated if at least a first input value falls below a first deactivation threshold and a second input value falls below a second deactivation threshold for at least a deactivation time.

6. The method according to claim 1, wherein the set of at least two input values comprises a crankshaft revolution speed and a combustion intake of the compression-ignition engine.

7. The method according to claim 1, wherein the at least one glowplug is activated if at least a first input value exceeds a first activation threshold and a second input value exceeds a second activation threshold for at least an activation time.

8. The method according to claim 1, wherein after activating the at least one glowplug the at least one glowplug remains activated for at least a hold time.

9. The method according to claim 1, wherein after deactivating the at least one glowplug, the at least one glowplug remains deactivated for at least a predetermined deactivation period.

10. The method according to claim 1, wherein the at least one glowplug continues to be activated and to be deactivated after a combustion chamber has reached a steady state value.

11. A computer readable medium embodying a computer program product, said computer program product comprising:

a program, the program configured to control a power supply to at least one glowplug of a compression-ignition engine for reducing emissions behind a catalytic converter in an exhaust gas stream of the compression-ignition engine and activate the at least one glowplug if a set of at least two input values remains in a first characteristic region of an input parameter space for at least a predetermined activation time and wherein the first characteristic region consists of one or more contiguous regions of the input parameter space.

12. The computer readable medium embodying the computer program product according to claim 11, the program further configured to deactivate the at least one glowplug if the set of at least two input values remains outside a second characteristic region of the input parameter space for at least a predetermined deactivation time and wherein the second characteristic region consists of one ore more contiguous regions of the input parameter space.

13. The computer readable medium embodying the computer program product according to claim 12, wherein the first characteristic region coincides with the second characteristic region.

14. The computer readable medium embodying the computer program product according to claim 12, wherein the first characteristic region and the second characteristic region are multidimensional cubes in the input parameter space.

15. The computer readable medium embodying the computer program product according to claim 12, wherein the at least one glowplug is deactivated if at least a first input value falls below a first deactivation threshold and a second input value falls below a second deactivation threshold for at least a deactivation time.

16. The computer readable medium embodying the computer program product according to claim 11, wherein the set of at least two input values comprises a crankshaft revolution speed and a combustion intake of the compression-ignition engine.

17. The computer readable medium embodying the computer program product according to claim 11, wherein the at least one glowplug is activated if at least a first input value exceeds a first activation threshold and a second input value exceeds a second activation threshold for at least an activation time.

18. The computer readable medium embodying the computer program product according to claim 11, wherein after activating the at least one glowplug the at least one glowplug remains activated for at least a hold time.

19. The computer readable medium embodying the computer program product according to claim 11, wherein after deactivating the at least one glowplug, the at least one glowplug remains deactivated for at least a predetermined deactivation period.

20. The computer readable medium embodying the computer program product according to claim 11, wherein the at least one glowplug continues to be activated and to be deactivated after a combustion chamber has reached a steady state value.

* * * * *